US008397422B2

(12) United States Patent
Bietsch

(10) Patent No.: US 8,397,422 B2
(45) **Date of Patent: *Mar. 19, 2013**

(54) GUN SIGHT ADJUSTMENT DEVICE

(76) Inventor: Michael B. Bietsch, Rio Rico, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/092,307

(22) Filed: Apr. 22, 2011

(65) Prior Publication Data

US 2011/0252688 A1 Oct. 20, 2011

Related U.S. Application Data

(63) Continuation-in-part of application No. 12/687,781, filed on Jan. 14, 2010, now Pat. No. 8,316,573.

(51) Int. Cl.
*F41G 11/00* (2006.01)
*F41C 27/00* (2006.01)

(52) U.S. Cl. ..... 42/124; 42/90; 42/111; 33/274

(58) Field of Classification Search ..... 42/124, 42/111, 137, 143, 90; 33/274, 286
See application file for complete search history.

(56) References Cited

U.S. PATENT DOCUMENTS 5,814,398 A 9/1998 Kronz et al.
5,864,957 A 2/1999 Small
D620,547 S 7/2010 Bietsch
2002/0073559 A1 6/2002 Johnson
2002/0152664 A1 10/2002 Mendoza-Orozco
2011/0167702 A1* 7/2011 Bietsch ..... 42/90
2011/0252688 A1* 10/2011 Bietsch ..... 42/90

OTHER PUBLICATIONS

International Search Report and Written Opinion dated Mar. 21, 2011.

* cited by examiner

*Primary Examiner* — Michael David
(74) *Attorney, Agent, or Firm* — Dale F. Regelman; Nikia L. Gray; Quarles & Brady LLP

(57) ABSTRACT

A device for adjusting a gun sight disposed in a dovetail groove on a gun slide is presented. The device includes a pushing member and a pressure plate both moveable in a first direction and an opposing second direction. The device further comprises a bracing member opposing the pressure plate, where the bracing member is stationary, and a seating member disposed between the pressure plate and bracing member, where the seating member opposes the pushing member, and where the seating member is movable in a third direction and an opposing fourth direction. When the gun slide is secured between the bracing member and the pressure plate, moving the pushing member adjusts the position of the gun sight.

17 Claims, 18 Drawing Sheets

GUN SIGHT ADJUSTMENT DEVICE

CROSS REFERENCE TO RELATED APPLICATIONS

This application claims priority to a U.S. Non Provisional Application having Ser. No. 12/687,781, which was filed on Jan. 14, 2010.

FIELD OF INVENTION

The present invention generally relates to devices for adjusting a sight on a gun, and more specifically relates to devices for adjusting a dovetail sight on pistols.

BACKGROUND

Most pistols are sold with front and rear sights that are each press fit into a dovetail slot on the slide of the pistol. Typically, to adjust or replace the sights a punch and hammer are used to knock the sight left or right as needed. But, even where a non-marring punch is used, the pounding on the sight can distort or break it. Furthermore, if the slide is stabilized using a vice or clamp, the slide can be scratched or marred during the process.

SUMMARY

In one implementation, a device for adjusting a gun sight disposed in a dovetail groove on a gun slide is presented. The device includes a pushing member and a pressure plate both moveable in a first direction and an opposing second direction. The device further comprises a bracing member opposing the pressure plate, where the bracing member is stationary, and a seating member disposed between the pressure plate and bracing member, where the seating member opposes the pushing member, and where the seating member is movable in a third direction and an opposing fourth direction. When the gun slide is secured between the bracing member and the pressure plate, moving the pushing member adjusts the position of the gun sight.

In another implementation, a method of adjusting a gun sight disposed within a dovetail grove of a gun slide is presented. The method includes supplying a gun sight adjusting device, where the device comprises a pushing member and a pressure plate both moveable in a first direction and an opposing second direction, a bracing member opposing the pressure plate, where the bracing member is stationary, and a seating member disposed between the pressure plate and bracing member, where the seating member opposes the pushing member, and where the seating member is movable in a third direction and an opposing fourth direction. The method further comprises supplying a pistol comprising a slide and a removeable sight moveably disposed in a groove formed in a top of the slide and extending the pistol into the gun sight adjustment device such that a portion of the slide is disposed between the pressure plate and the bracing member. The method further includes moving the seating member in the third direction to position the sight adjacent to the pushing member, moving the pressure plate in the first direction to fixture the slide between the pressure plate and the bracing member, and moving the pushing member to adjust the position of the sight in the groove.

BRIEF DESCRIPTION OF THE DRAWINGS

Implementations of the invention will become more apparent from the detailed description set forth below when taken in conjunction with the drawings, in which like elements bear like reference numerals.

DETAILED DESCRIPTION

This invention is described in preferred embodiments in the following description with reference to the Figures, in which like numbers represent the same or similar elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of the invention may be combined in any suitable manner in one or more embodiments. In the following description, numerous specific details are recited to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow charts included are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1:
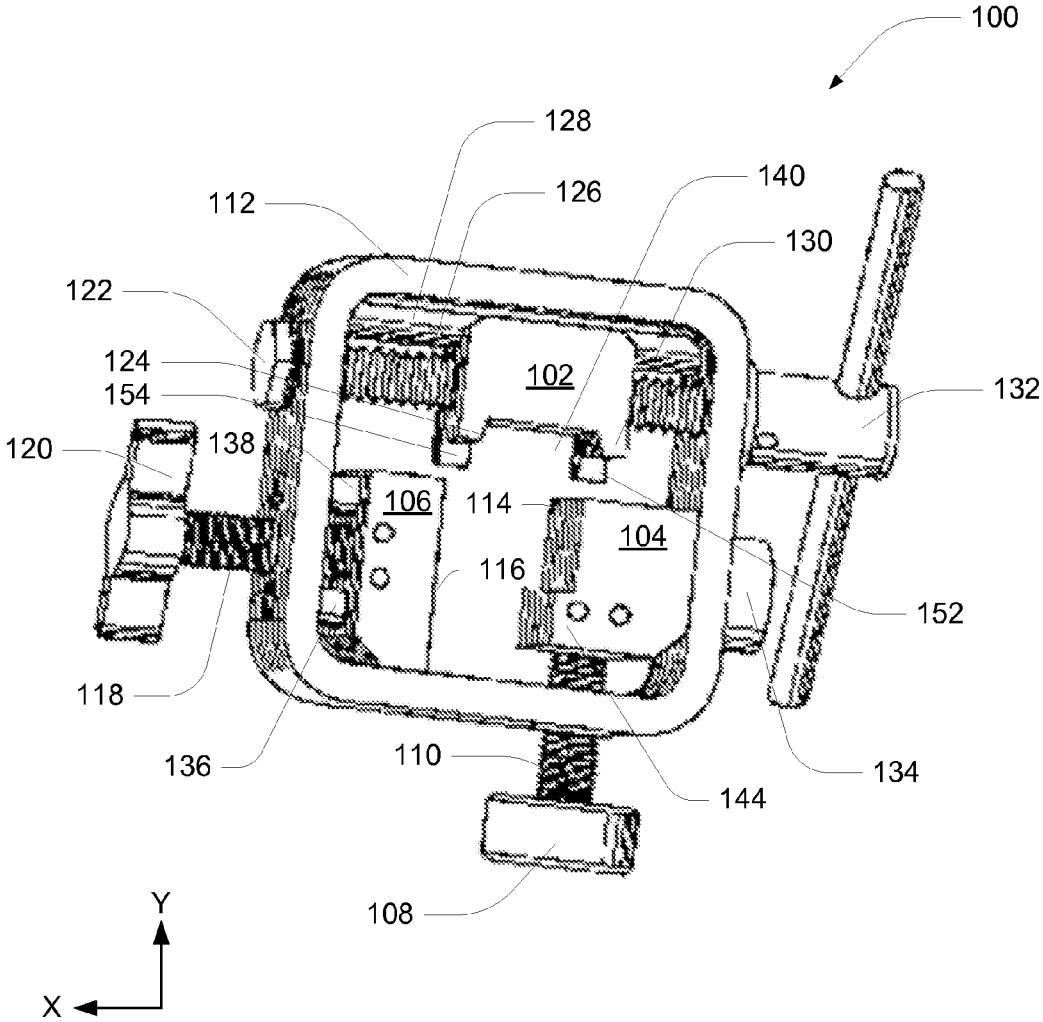
FIG. 1 is a perspective view of an embodiment of a gun sight adjustment device according to the present invention.
Figure 2:
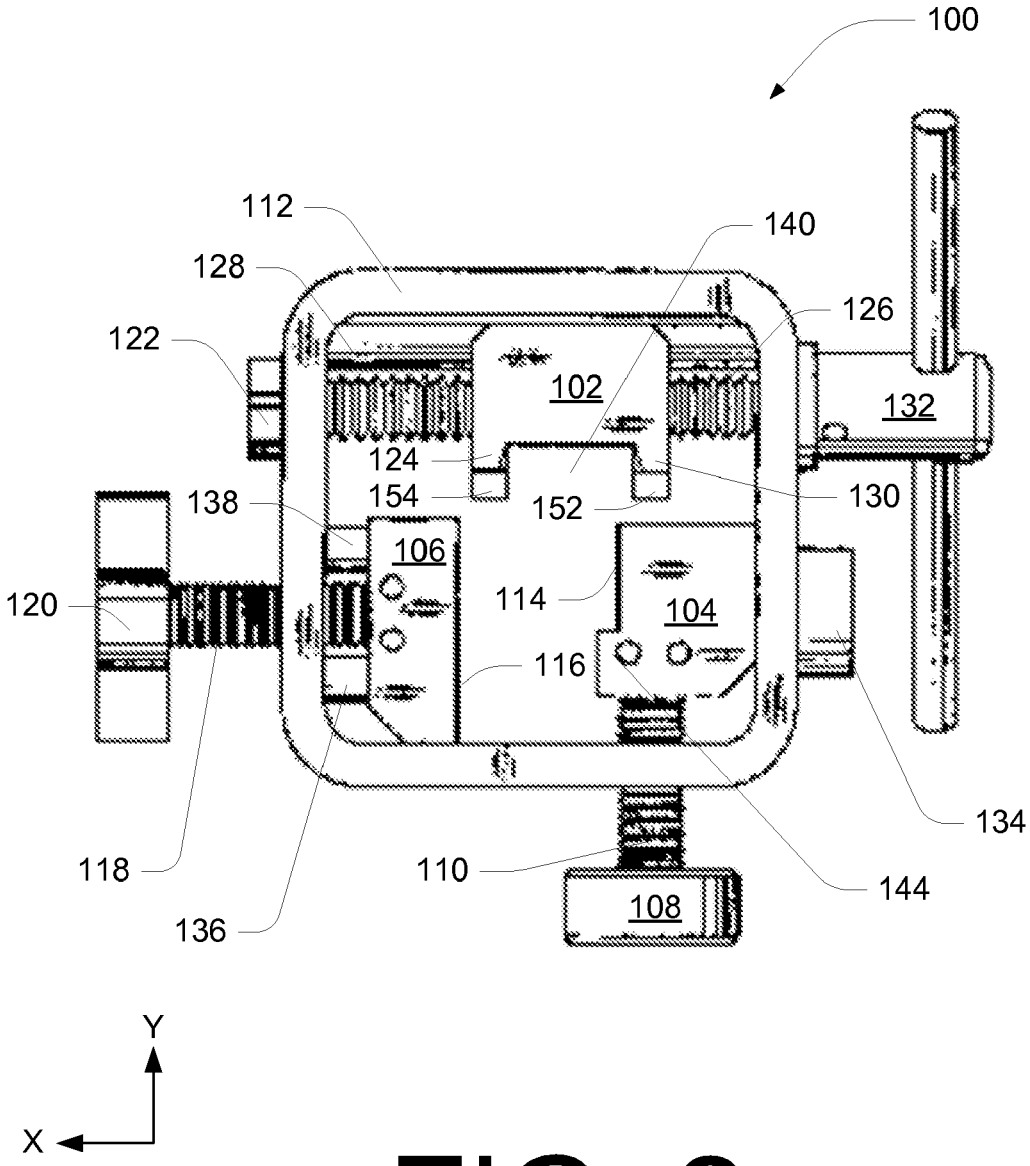
FIG. 2 is a front side elevational view of the gun sight adjustment device of FIG. 1.
Figure 3:
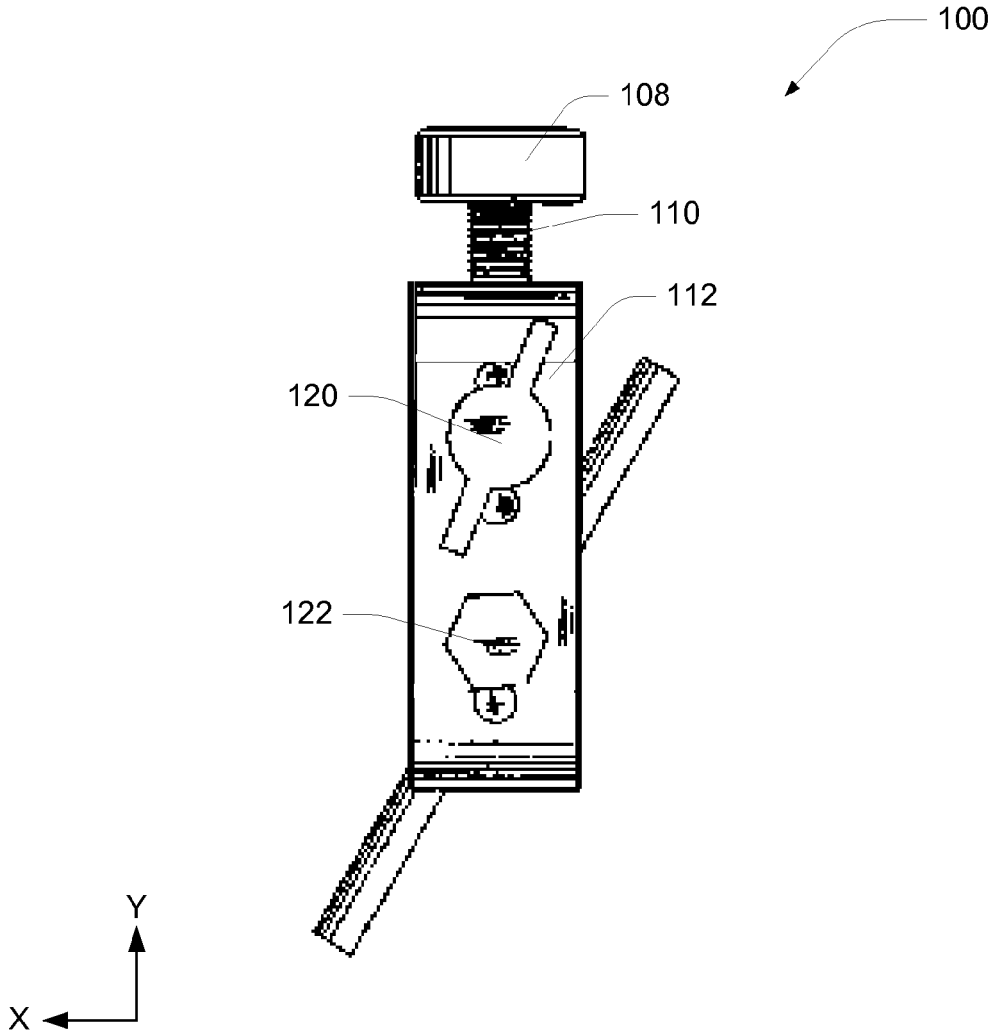
FIG. 3 is a first side view thereof.
Figure 4:
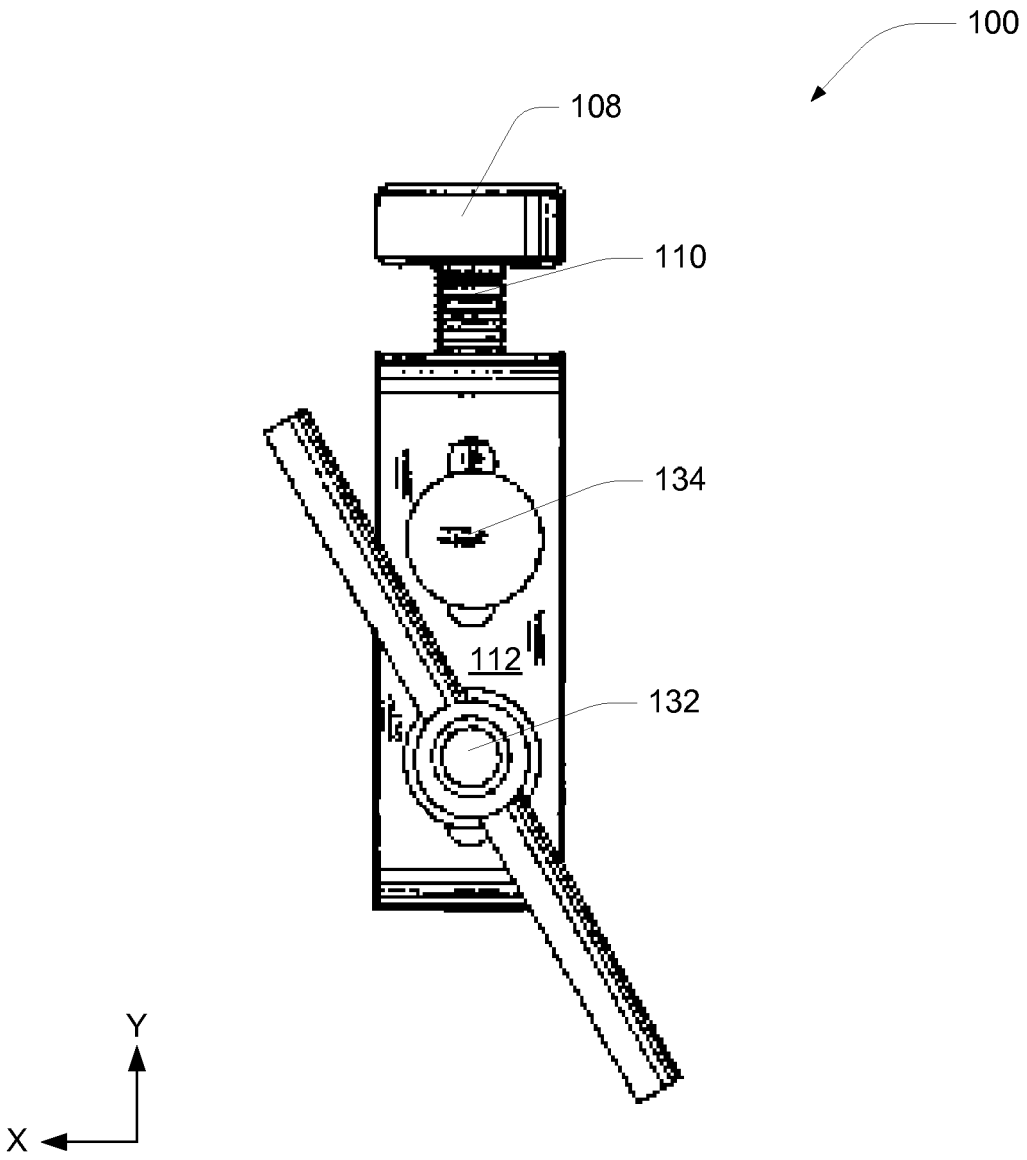
FIG. 4 is a second side view thereof.
Figure 5:
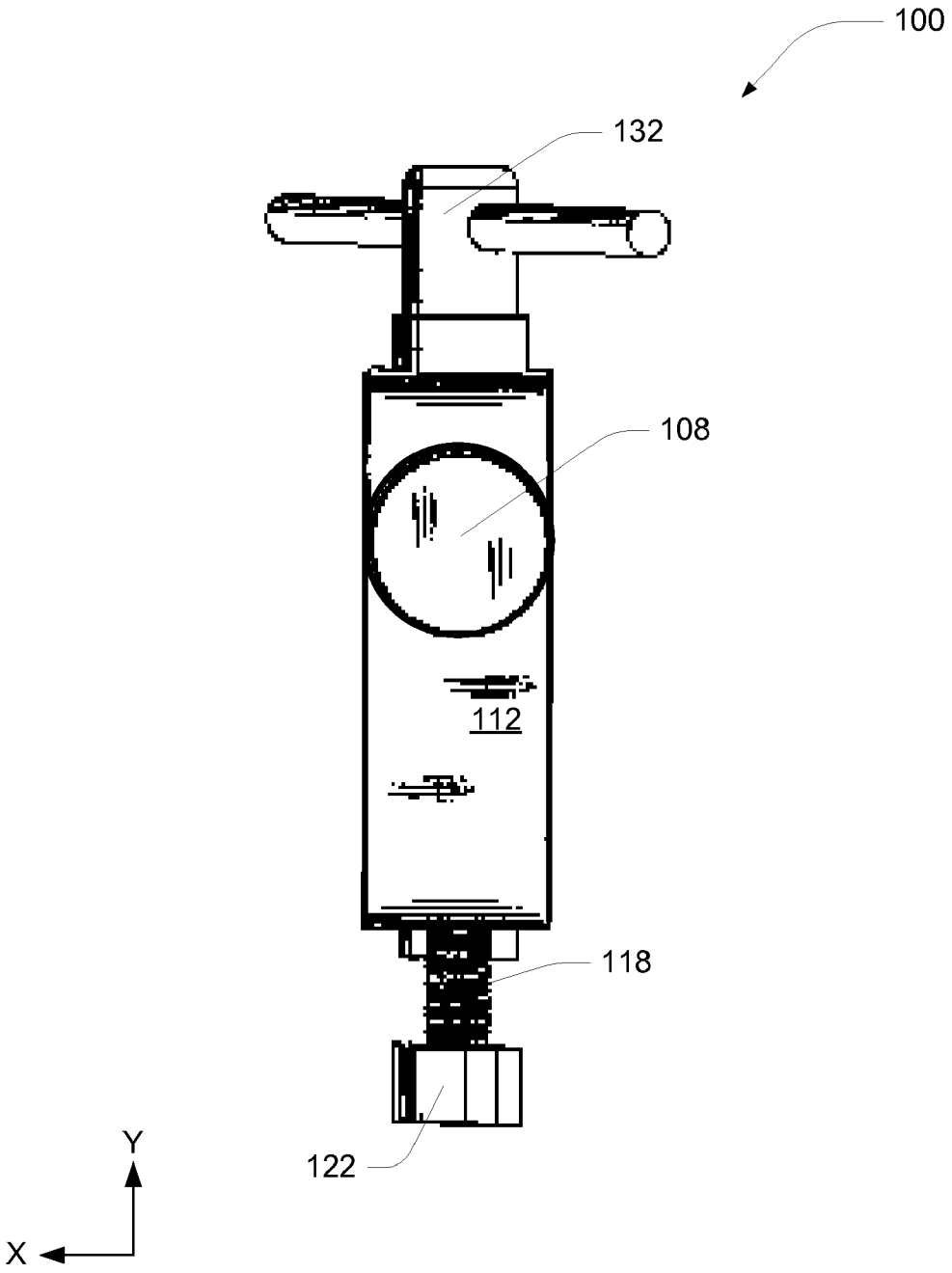
FIG. 5 is a third side view thereof.
Figure 6:
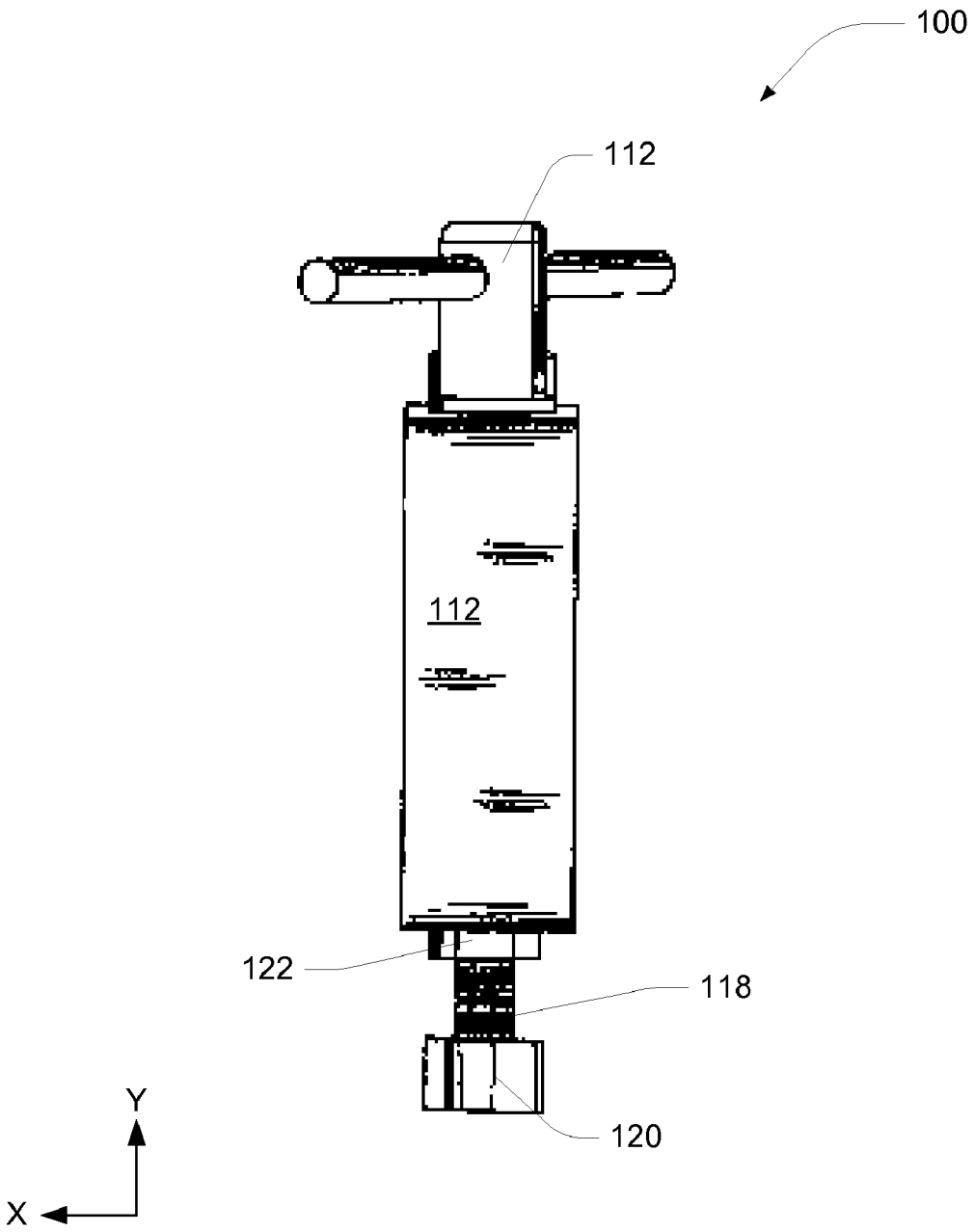
FIG. 6 is a fourth side view thereof.
Figure 9:
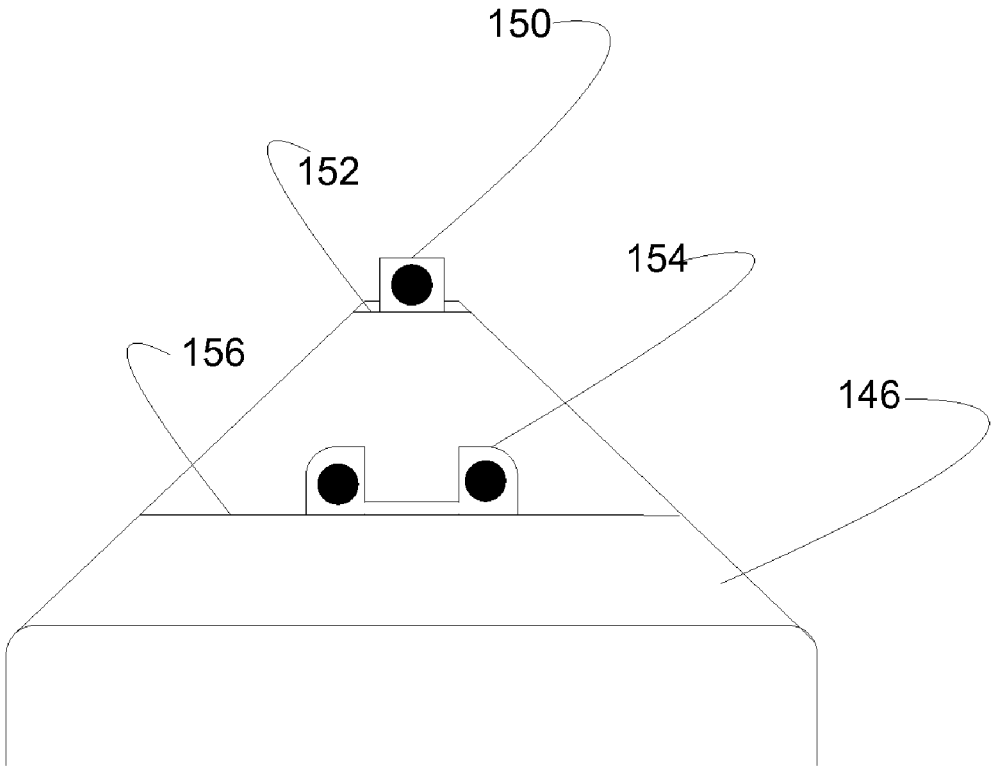
FIG. 9 is an exemplary depiction of a front gun sight and rear gun sight disposed within dovetail grooves on a slide.

Turning now to FIG. 2, an elevational view of an embodiment of a gun sight adjustment device according to Applicant's invention is presented. FIGS. 1 and 3-6 provide additional views of Applicant's invention. Although Applicant's invention is described herein in terms of adjusting a front sight of a hand gun, Applicant's invention can be used to adjust a rear sight as well. Furthermore, Applicant's invention is capable of adjusting the sights on any type of hand gun where those sights are moveably disposed within a dovetail groove. For example and referring now to FIG. 9, front sight 150 and rear sight 154 are shown disposed on a top surface of slide 146. Front sight 150 is shown moveably disposed within groove 152. Rear sight 154 is shown moveably disposed within groove 156.

As can be seen in the illustrated embodiment of FIG. 2, gun sight adjustment device 100 comprises frame 112, pushing member 102, tail assembly 104, and pressure plate 106. In certain embodiments, frame 112 is 3.5×3.5 inches and comprises hot rolled tubing. In other embodiments, frame 112 is 3×3 inches. In other embodiments, frame 112 comprises aluminum. In certain embodiments, frame 112 is rectangular. In certain embodiments, frame 112 is square.

Pushing member 102 is moveably disposed on both screw 126 and on guide rod 128, wherein screw 126 and guide rod 128 extend through opposing sides of frame 112. Rotating cross-bar handle 132 in a first direction causes pushing member 102 to move in a first direction along the X-axis shown in FIG. 2. Rotating cross-bar handle 132 in a second and opposite direction causes pushing member 102 to move in a second and opposite direction along the X-axis shown in FIG. 2.

In certain embodiments, pushing member 102 further formed to include at least one protrusion, such as protrusion 124, 130, 152, and/or 154 extending outwardly therefrom. Opening 140, defined by protrusion 124, 130, 152, and/or 154, receives a gun sight. In certain embodiments, pushing member 102 comprises a protrusion to either side of, and defining, opening 140. In certain embodiments, the protrusions are angled inwardly. In certain embodiments, pushing member 102 comprises only one protrusion, either protrusion 152 or 154. In certain embodiments, pushing member 102 has a plurality of protrusions, where at least one protrusion comprises a flat distal end and at least one protrusion comprises an angled distal end. In certain embodiments, pushing member 102 comprises any type of steel. In certain embodiments, pushing member 102 comprises 4140 pre-heat treated steel.

In certain embodiments, screw 126 comprises a ⅜-16 screw.

In certain embodiments, screw 118 comprises grade 5 black 4" steel. In certain embodiments screw 118 comprises grade 3 black 4" steel. In certain embodiments screw 118 comprises grade 8 black 4" steel.

In certain embodiments, guide rod 128 comprises 303 stainless steel. In certain embodiments, guide rod 128 comprises any other type of steel.

In certain embodiments, cross-bar handle 132 comprises aluminum. In certain embodiments, cross-bar handle 132 comprises 303 stainless steel. In certain embodiments, cross-bar handle 132 comprises a combination thereof. In certain embodiments, cross-bar handle 132 comprises any other type of steel.

Tail assembly 104 and pressure plate 106 are positioned within frame 112 such that fixturing surface 114 of tail assembly opposes fixturing surface 116 of pressure plate 106. In certain embodiments, tail assembly 104 and pressure plate 106 comprise the same material. In certain embodiments, tail assembly 104 and pressure plate 106 comprise different materials. In certain embodiments, tail assembly 104 and pressure plate 106 comprise 1018 mild steel. In certain embodiments, tail assembly 104 and pressure plate 106 comprise any other type of steel. In certain embodiments, tail assembly 104 and pressure plate 106 comprise aluminum.

Pressure plate 106 is moveably disposed on screw 118 and guide rods 138 and 136. Handle 120, when turned, moves pressure plate 106 in the X-direction and towards tail assembly 104, thereby causing an object, such as a gun barrel, placed between pressure plate 106 and tail assembly 104 to press against tail assembly 104 and to be secured therebetween. Guide rods 138 and 136 function to stabilize pressure plate 106 such that pressure plate 106 does not rotate relative to tail assembly 104 when applying pressure to an object therebetween.

In certain embodiments, screw 118 is a 5/16-18 screw. In certain embodiments, screw 118 comprises grade 5 zinc plated 1½" steel. In certain embodiments screw 118 comprises grade 3 zinc plated 1½" steel. In certain embodiments screw 118 comprises grade 8 zinc plated 1½" steel.

In certain embodiments, one or more of fixturing surface 114, fixturing surface 116, tail assembly 104, and/or pressure plate 106, are coated. In such embodiments, fixturing surfaces 114 and 116 are coated with a polyurethane-polyurea elastomer. As will be appreciated by one of ordinary skill in the art, such a coating will prevent the gun slide from being scratched or scored when secured between tail assembly 104 and pressure plate 106.

Figure 7:
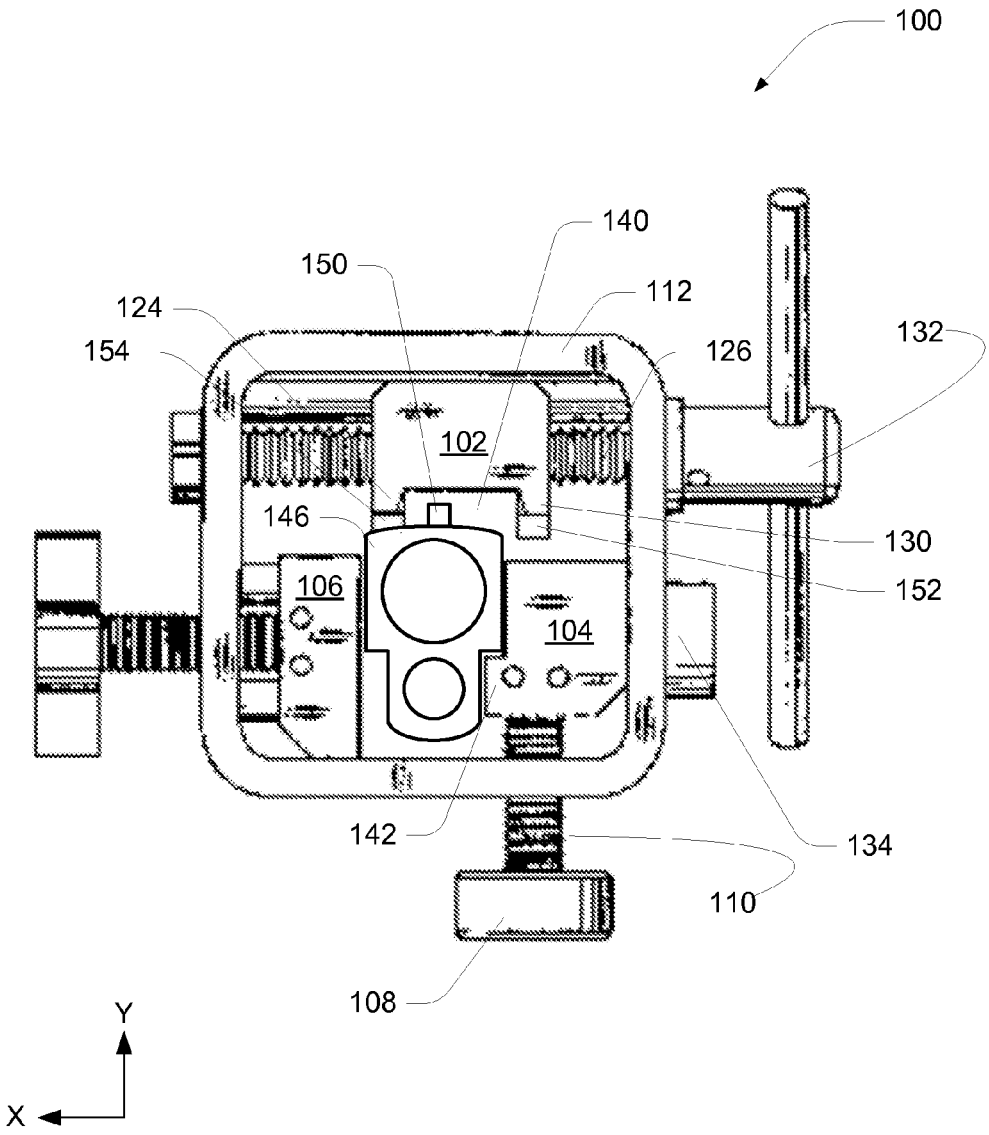
FIG. 7 is an exemplary depiction of a slide having a gun sight secured within the gun sight adjustment device of FIG. 1.

In certain embodiments, tail assembly 104 is further formed to include ledge 144 on fixturing surface 114. Turning to FIG. 7, when gun slide 146 is clamped between pressure plate 106 and tail assembly 104, ledge 144 mates with a recession defined by the slide, as illustrated, thereby further securing the slide and preventing the slide from moving as the sight is adjusted.

As can also be seen in the Illustrated embodiment of FIG. 7, in certain embodiments, tail assembly 104 is further moveably disposed on screw 110, such that rotating screw 110 moves tail assembly 104 in the Y-direction. Thus, when gun slide 146 is secured between pressure plate 106 and tail assembly 104, moving tail assembly in a Y direction positions a sight, such as sight 150, upwardly or downwardly within opening 140. Lock 134 secures tail assembly 104 after selecting a desired position for sight 150.

In certain embodiments, screw 110 is a 5/16-18 screw. In certain embodiments, screw 110 comprises grade 5 zinc plated 1½" steel. In certain embodiments screw 110 comprises grade 3 zinc plated 1½" steel. In certain embodiments screw 110 comprises grade 8 zinc plated 1½" steel.

As depicted in the illustrated embodiment of FIG. 7, when slide 146 is secured between pressure plate 106 and tail assembly 104, sight 150, here depicted as a front sight, is within opening of 140 of pushing member 102. When cross-bar handle 132 is turned, thereby rotating screw 126, pushing member 102 moves in the X-direction. Protrusion 124, 130, 152, or 154, depending on the direction cross-bar handle 132 is turned, will press against the side of sight 150 and apply pressure. As will be known to one of ordinary skill in the art, sight 150 is positioned within a dovetail grove (not shown) on slide 146, wherein the dovetail grove is cut perpendicular to the length of slide 146. Thus, the pressure applied to sight 150 by protrusion 124, 130, 152, or 154 will push sight 150 linearly within dovetail grove, thereby allowing for the installation, removal, or adjustment, of sight 150.

Figure 8:
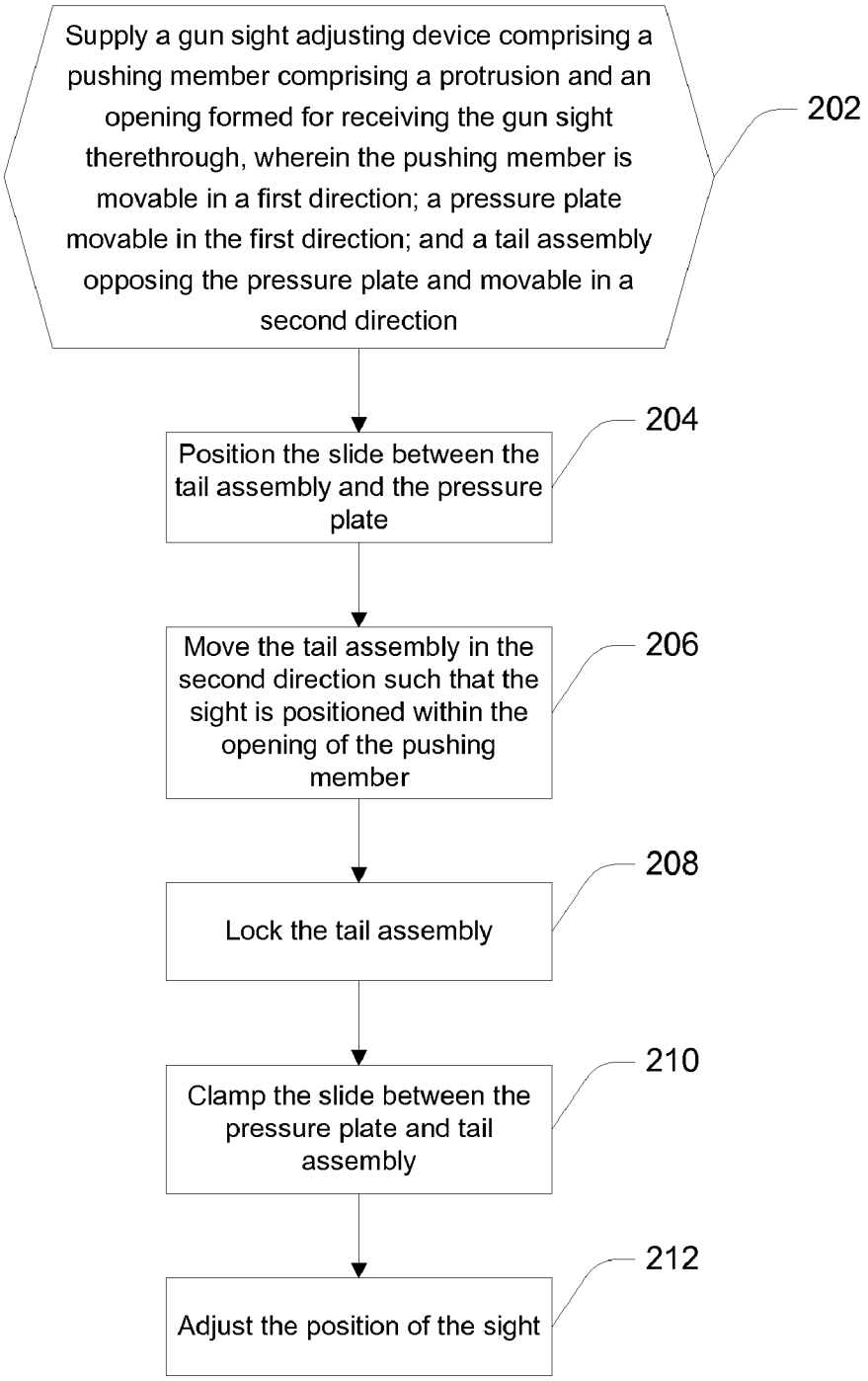
FIG. 8 presents an exemplary flowchart of a method of using the gun sight adjustment device of FIG. 1.

Turning now to FIG. 8, a flow chart of a method of using Applicant's invention is presented. As can be seen in the illustrated embodiment of FIG. 8, to start, a sight adjusting device according to applicant's invention is provided, as indicated by block 202. As indicated by block 204, the slide of a gun is positioned between the tail assembly and the pressure plate such that the sight being installed, removed, or adjusted, is within the opening of the adjusting member. When a sight is being installed, the sight should first be placed at one edge of the dovetail groove such that an edge of the sight is held in place by friction. As will be further appreciated by one of ordinary skill in the art, the slide may be positioned between the tail assembly and the pressure plate such that either protrusions 130 and 124 or protrusions 152 and 154 of pushing member 102 are forward depending on whether the sight being removed or installed is angled.

In certain embodiments, after the sight is situated within the opening of the pushing member, the position of the sight is further adjusted such that the protrusions of the pushing member, such as protrusions 124 and 130 or protrusions 152 and 154 (FIG. 7), intersect with the dovetail of the slide. Optimally, the sight should be positioned such that there is enough clearance between the slide and the protrusions such that the protrusions are able to push against the sight without scraping the slide itself. In certain embodiments, to position the sight, the tail assembly is moved in a second direction either towards or away from the pushing member by rotating the screw the tail assembly is disposed on, as indicated in block 206. In certain embodiments, the tail assembly is then locked into position, as indicated in block 208.

As can be seen in FIG. 7, in certain embodiments, tail assembly 104 includes ledge 144 along fixturing surface 114. Ledge 144 is designed to capture slide 146, where a portion of slide 148 rests on ledge 144 and secures slide 146 such that slide 146 cannot rotate when pressure is applied.

Returning to FIG. 8, once the sight is properly positioned within the opening of the pushing member, the slide can be clamped in place between the pressure plate and tail assembly, as indicated by block 210. To clamp the slide, the pressure plate is moved towards the tail assembly until the slide is secured such that the slide will not rotate. As will be appreciated by one of ordinary skill in the art, the coating disposed on the fixturing surfaces of the tail assembly and pressure plate prevent the slide from being scratched or otherwise damaged when claimed between the tail assembly and pressure plate.

Finally, as indicated by block 212, the position of the sight is adjusted by moving the pushing member such that one of the protrusions of the pushing member pushes against a side of the sight until the sight is installed, removed, or adjusted.

Figure 10A:
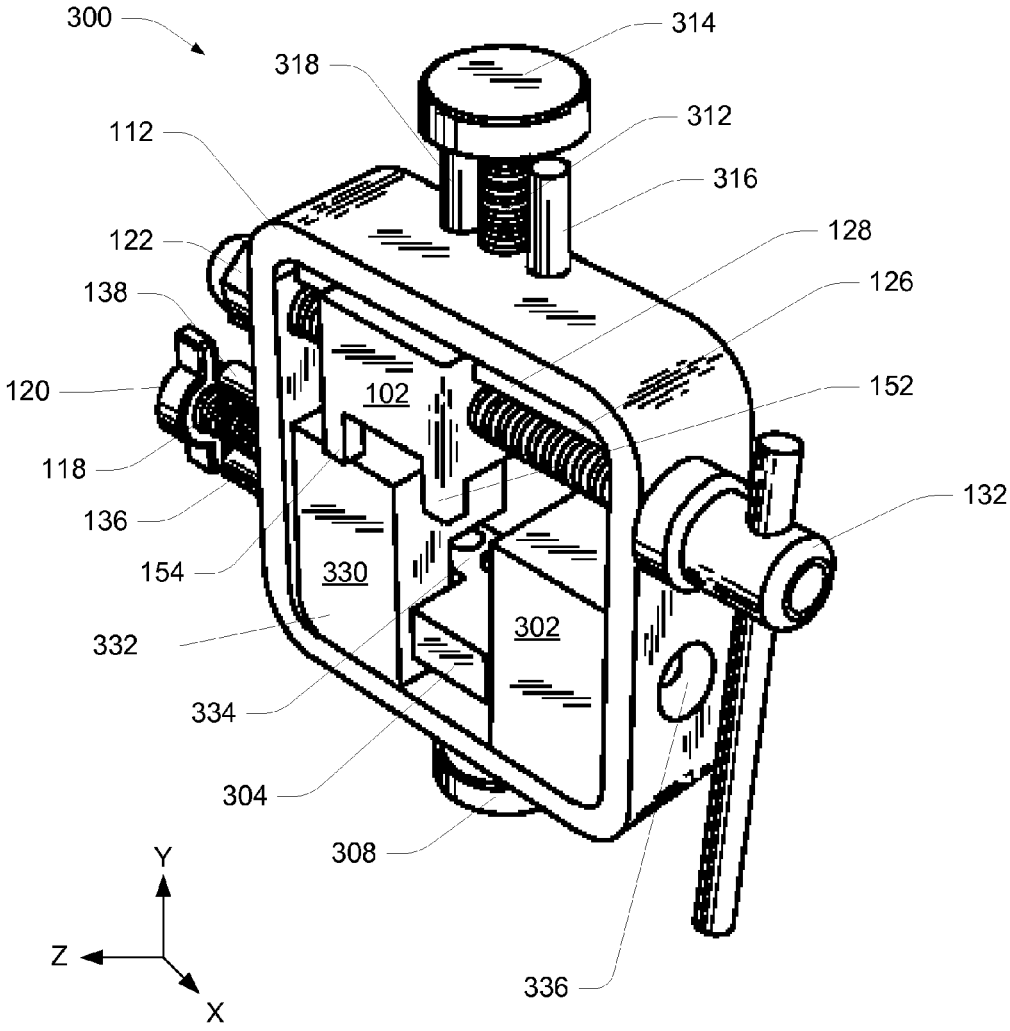
FIG. 10A is a front side perspective view of an alternate embodiment of a gun sight adjustment device according to the present invention.
Figure 10B:
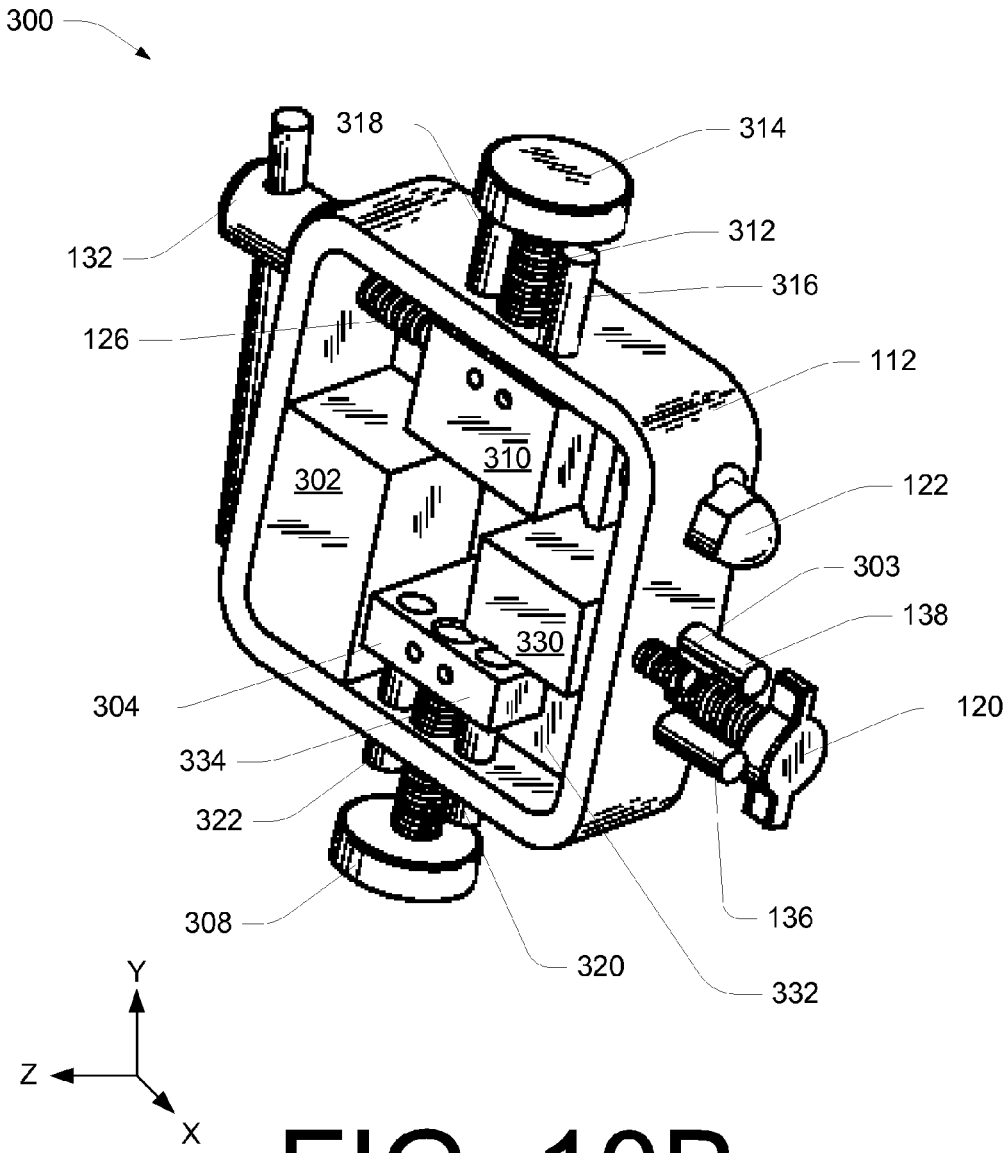
FIG. 10B is a rear side perspective view of FIG. 10A.
Figure 11:
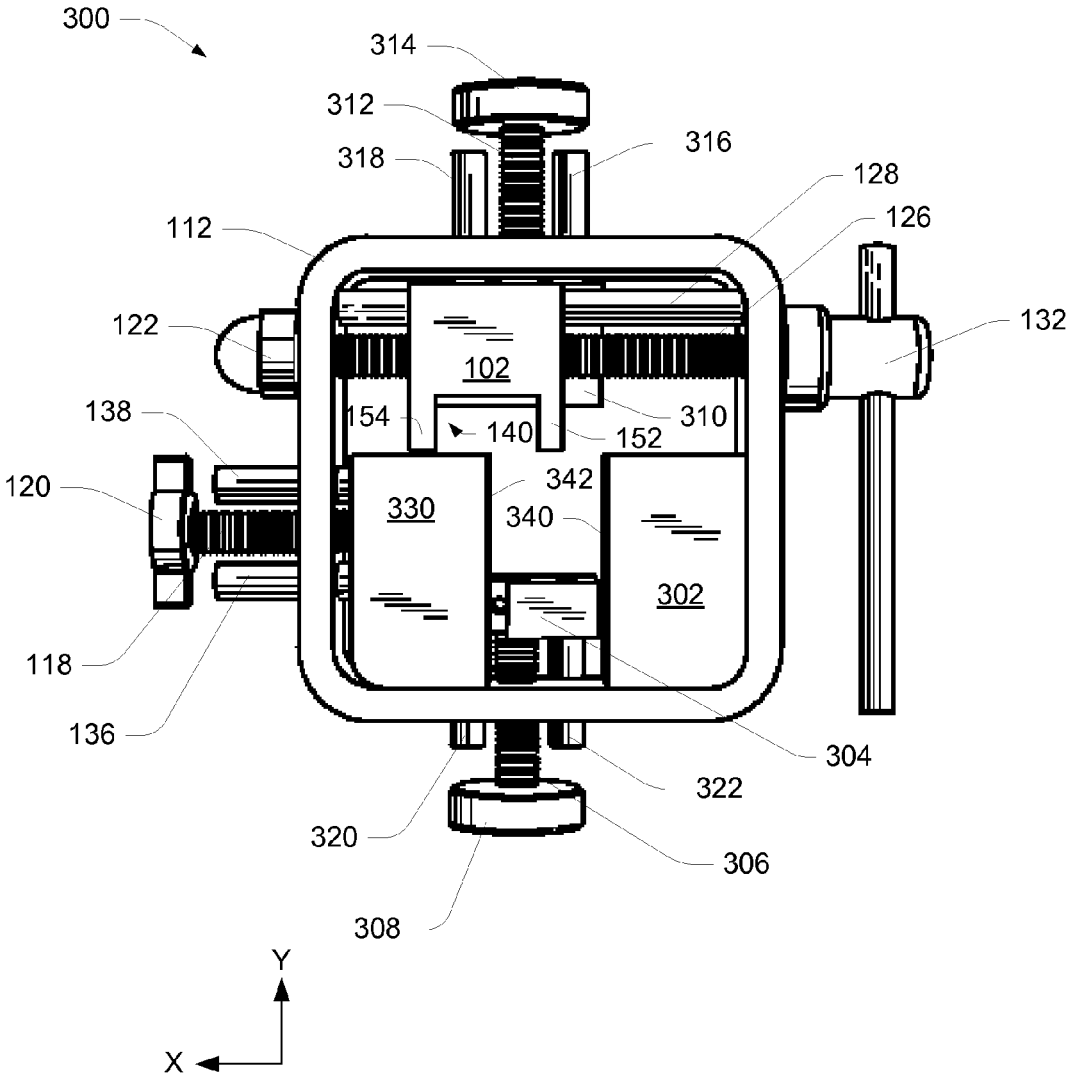
FIG. 11 is a front side elevational view of the gun sight adjustment device of FIG. 10A.

Turning now to FIG. 11, a front elevational view of an embodiment of a gun sight adjustment device according to another embodiment of Applicant's invention. FIGS. 10A-16 provide additional views of the embodiment of FIG. 11. As can be seen in the illustrated embodiment of FIG. 11, alternative gun sight adjustment device 300 comprises frame 112, pushing member 102, bracing member 302, pressure plate 330, and seat 302.

In the illustrated embodiment of FIG. 11, bracing member 302 and pressure plate 330 are positioned within frame 112 such that fixturing surface 340 of bracing member 302 opposes fixturing surface 342 of pressure plate 330. Pressure plate 330 is moveably disposed on screw 118. Handle 120, when turned, moves pressure plate 330 in the X-direction and towards bracing member 302, thereby causing an object, such as a gun barrel, placed between pressure plate 330 and bracing member 302 to press against bracing member 302 and to be secured therebetween. Guide rods 138 and 136 function to stabilize pressure plate 330 such that pressure plate 330 does not rotate relative to tail assembly 104.

Figure 14:
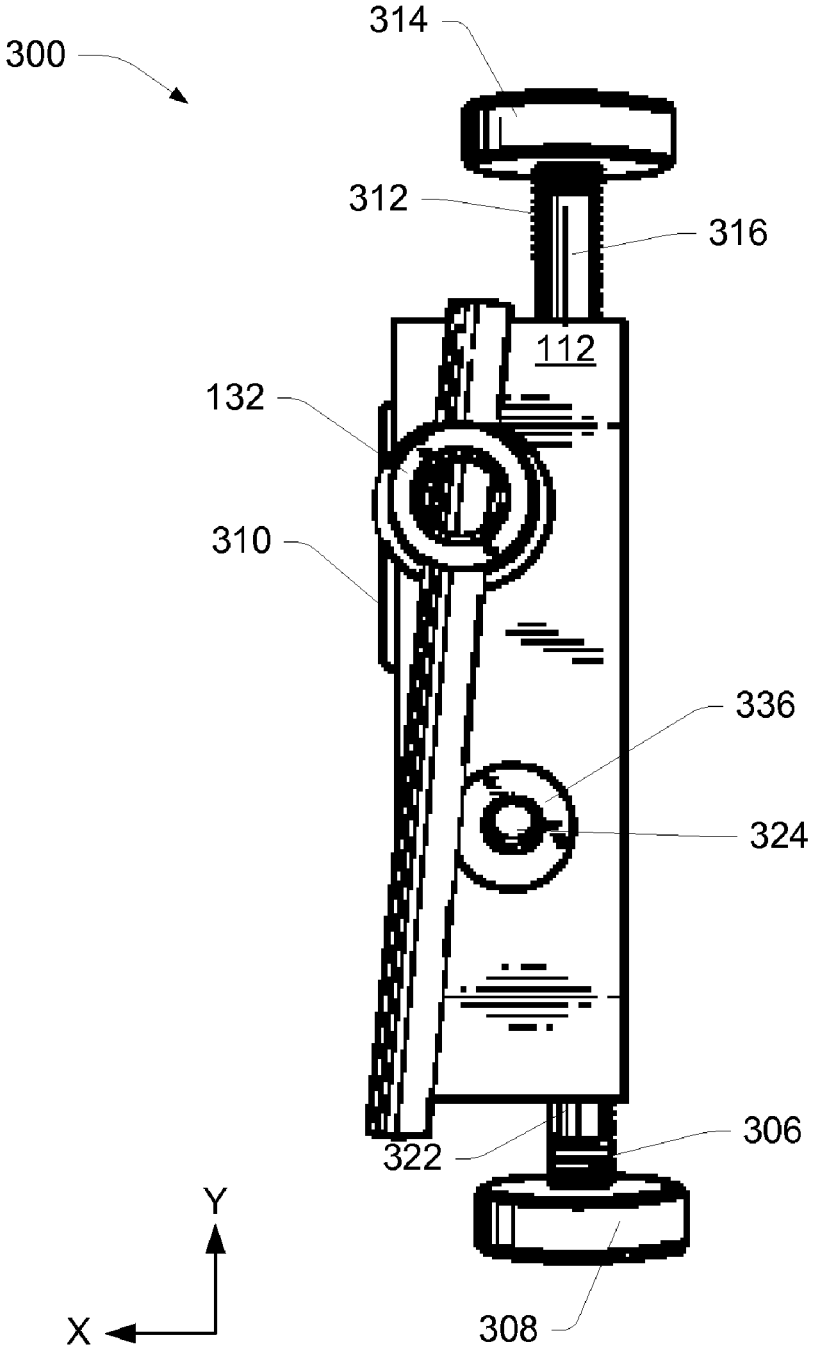
FIG. 14 is a second side view thereof.
Figure 15:
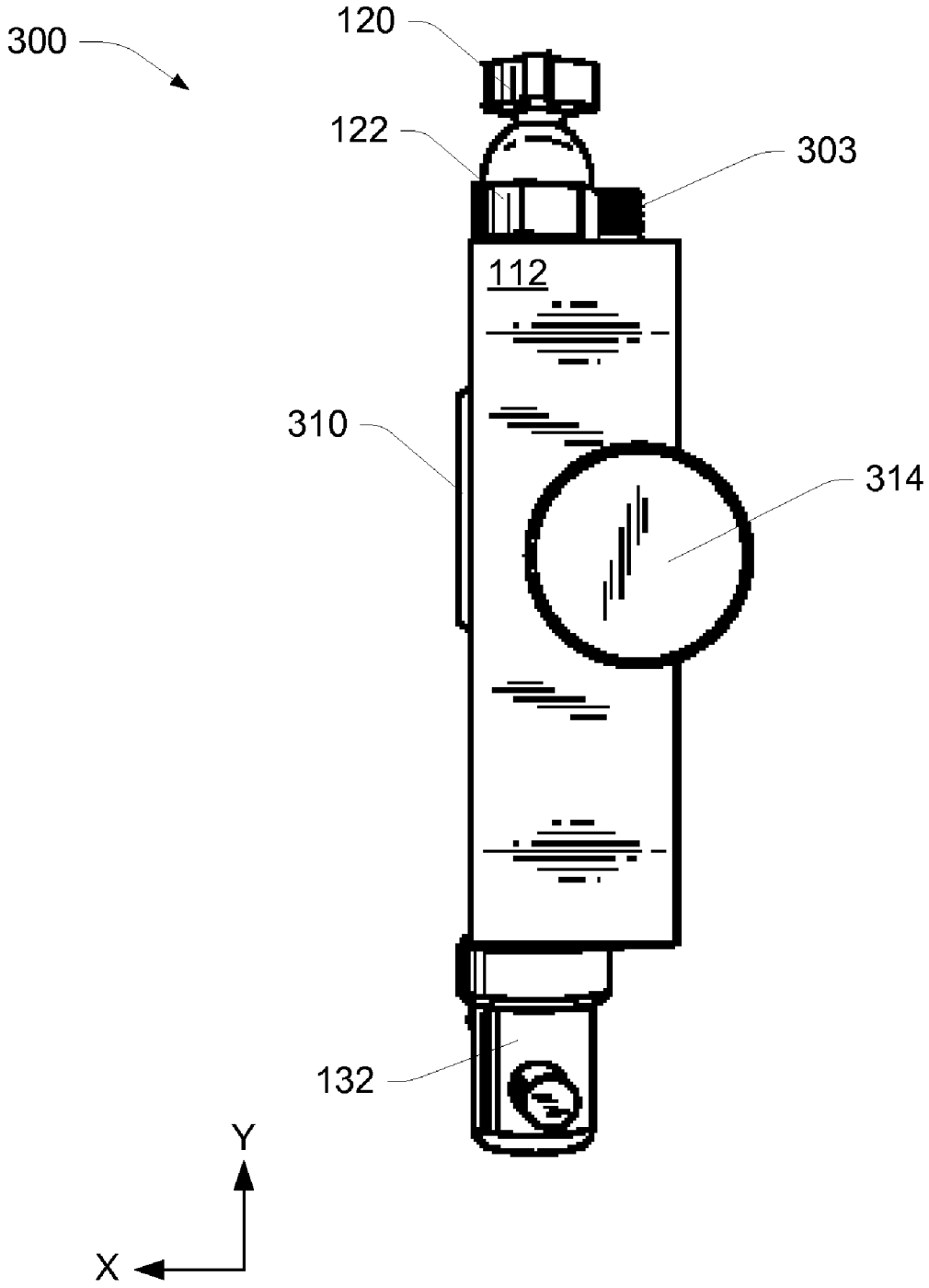
FIG. 15 is a third side view thereof.
Figure 16:
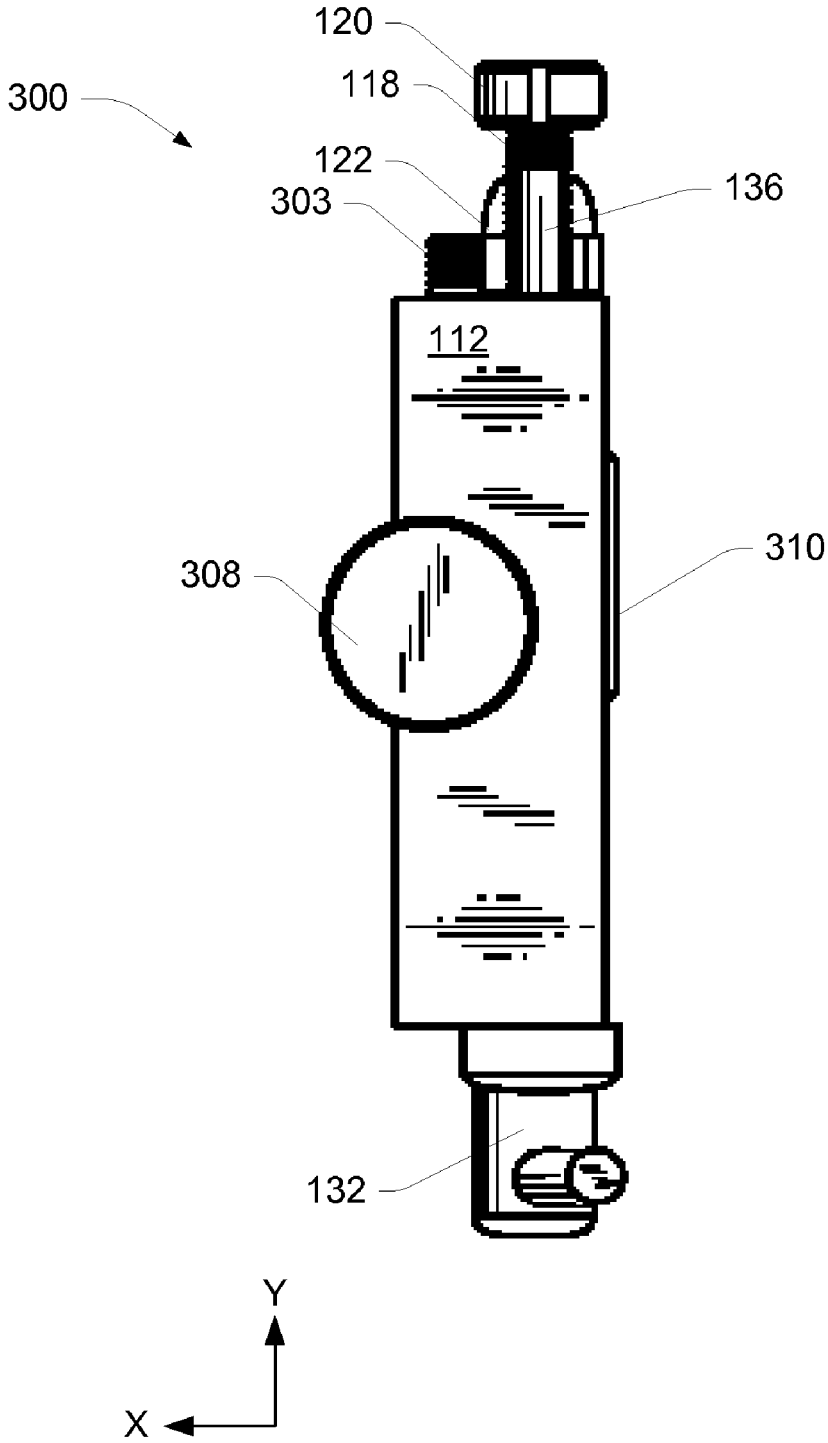
FIG. 16 is a fourth side view thereof.

As can be seen in FIG. 11 in certain embodiments bracing member 302 is stationary. In such embodiments, bracing member 302 is secured to frame 112 via screw 334 (FIG. 14) disposed in bore 334 (FIG. 14).

Seat 304 is moveably disposed on screw 306, wherein by rotating handle 308 seat 304 is caused to move in the Y-direction. When a slide portion of a pistol is secured between bracing member 302 and pressure plate 330, seat 304 can be adjusted by rotating handle 308 such that seat 304 provides support on the bottom of the slide. Additionally, by bracing the bottom of the slide, seat 304 prevents the slide from rotating when a torque force is applied to a sight by pushing member 102.

Figure 12:
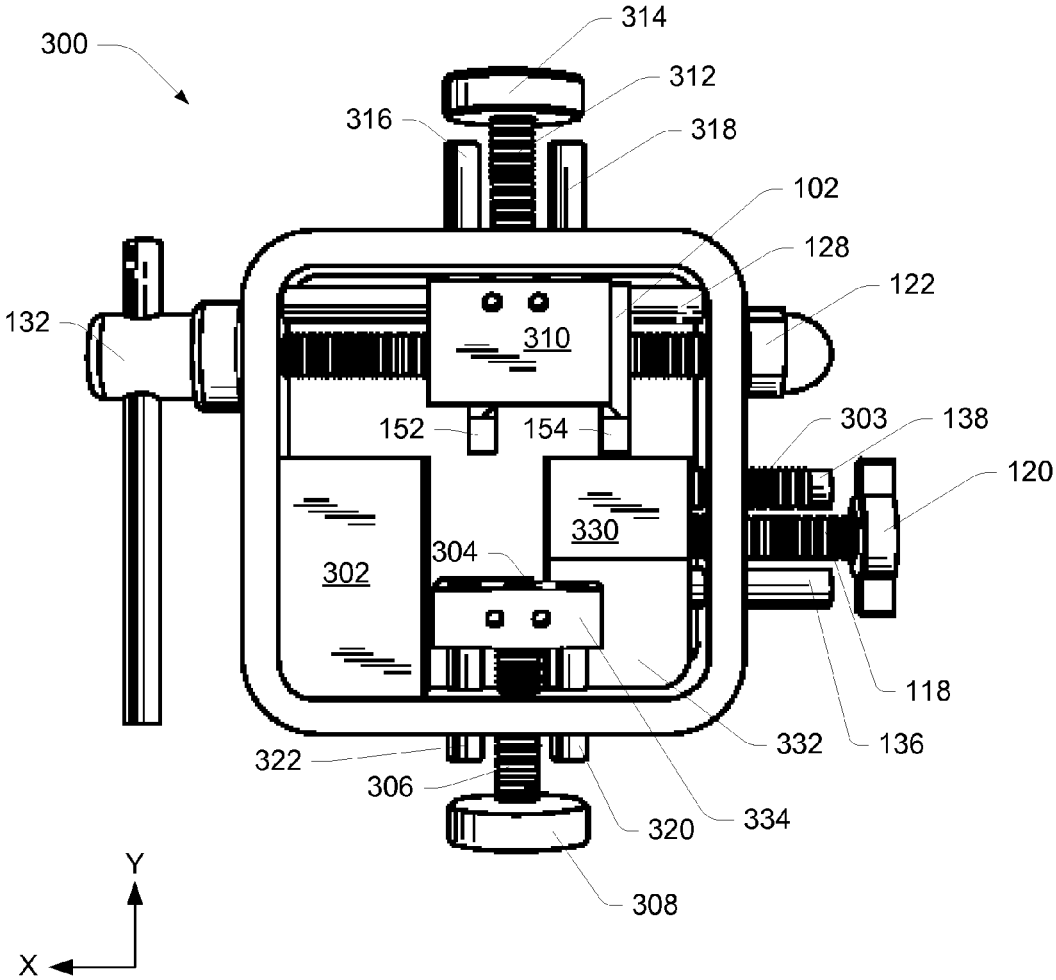
FIG. 12 is a rear side elevational view of the gun sight adjustment device of FIG. 10A.
Figure 13:
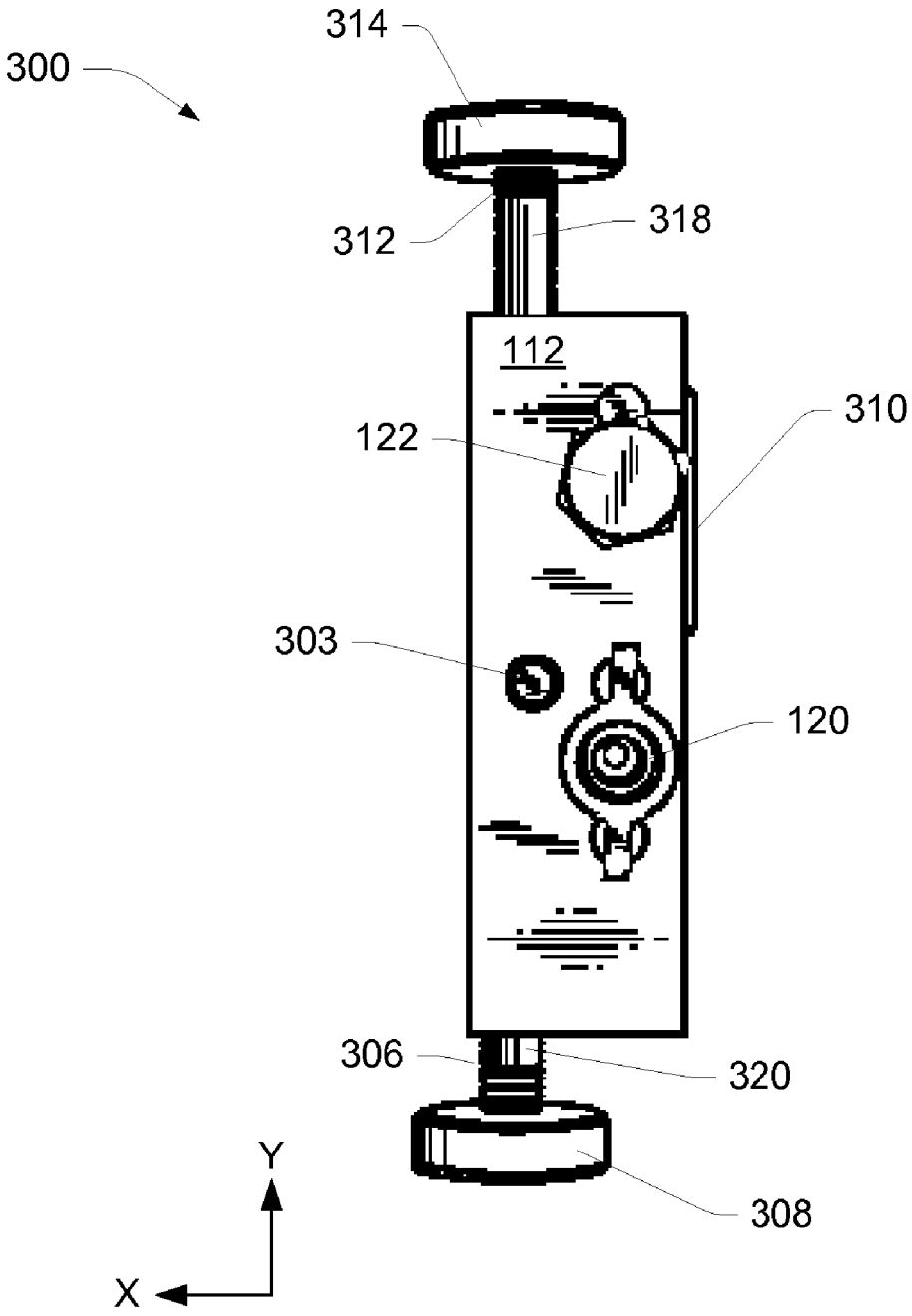
FIG. 13 is a first side view thereof.

As can be seen in FIG. 12, in certain embodiments, pressure plate 330 and seat 304 have interlocking shapes. More specifically, in such embodiments, pressure plate 330 is formed to include extension 332 which extends orthogonal to extension 334 of seat 304. An alternate view of the configuration of seat 304 and pressure plate 330 is shown in FIGS. 10A and 10B. By having interlocking shapes, pressure plate 330 and seat 304 can each have a greater size with only minimal restriction to their movement. This larger size in turn allows each to be mounted on guide rods for added stability. More specifically, seat 304 is disposed on guide rods 320 and 322 and pressure plate 330 is disposed on guide rods 138, 136, and 303.

In certain embodiments, pressure plate 330 and bracing member 302 comprise the same material. In other embodiments, pressure plate 330 and bracing member 302 comprise different materials. In certain embodiments, pressure plate 330 and bracing member 302 comprises a plastic material. In certain embodiments, pressure plate 330 and bracing member 302 comprises a thermoplastic. In certain embodiments, pressure plate 330 and bracing member 302 comprises a thermosetting plastic. In other embodiments, pressure plate 330 and bracing member 302 comprises an elastomer. In certain embodiments, pressure plate 330 and bracing member 302 comprises a metal.

In certain embodiments, gun sight adjustment device 300 further comprises supporting member 310. In such embodiments, supporting member 310 is disposed on screw 312 and guide rods 316 and 318, where screw 312 extends through frame 112. Supporting member 310 is positioned such that it is adjacent to, but at one side of, pushing member 102 and does not interfere with the movement of pushing member 102. In alternative embodiments, supporting member 310 is positioned on either side of pushing member 102. As will be appreciated by one of ordinary skill in the art, when device 300 is being used to remove a gun sight, a force will be applied across the slide, positioned between pressure plate 330 and bracing member 302. Supporting member 310 assists with securing the slide and preventing it from rotating.

In certain embodiments, supporting member 310 comprises a plastic material. In certain embodiments, supporting member 310 comprises a thermoplastic. In certain embodiments, supporting member 310 comprises a thermosetting plastic. In other embodiments, supporting member 310 comprises an elastomer. In certain embodiments, supporting member 310 comprises a metal.

In certain embodiments, one or more of fixturing surface 340, fixturing surface 342, bracing member 302, pressure plate 330, supporting member 310, and/or seat 304 are coated. In such embodiments, one or more surfaces thereof are coated with a polyurethane-polyurea elastomer. As will be appreciated by one of ordinary skill in the art, such a coating will prevent the gun slide from being scratched or scored when secured between bracing member 302 and pressure plate 330.

Figure 17:
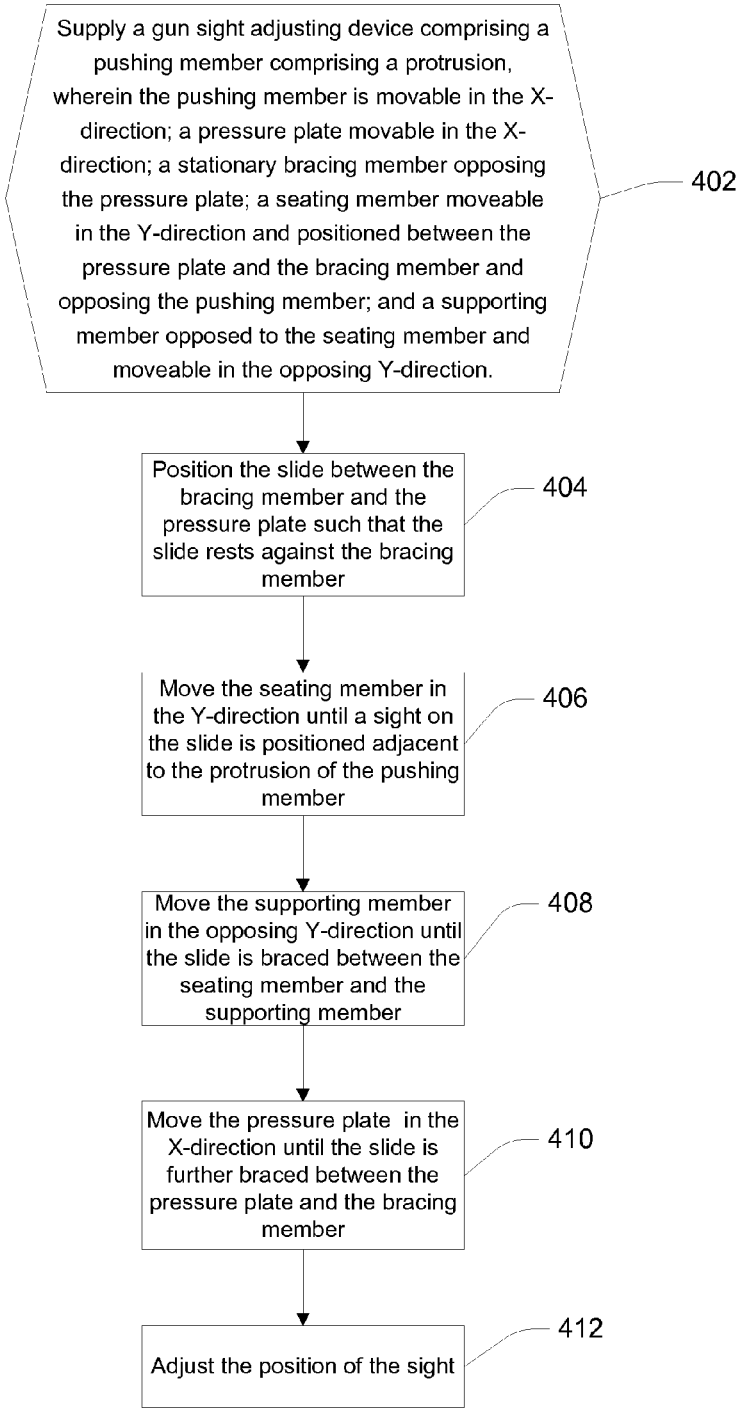
FIG. 17 is an exemplary flowchart of a method of using the gun sight adjustment device of FIG. 10A.

Turning now to FIG. 17 a flow chart of a method of using the embodiment of FIGS. 10A-16 to adjust a gun sight. As can be seen in the illustrated embodiment of FIG. 17, a gun sight adjustment device according to the embodiment of FIGS. 10A-16 is provided, as indicated by block 402. As indicated by block 404, a slide of a gun is positioned between the bracing member and the pressure plate such that the slide rests against the bracing member. As indicated by block 406, the seating member is raised (i.e., moved in the Y-direction) until the sight is positioned adjacent to the protrusion of the pushing member. Optimally, the sight should be positioned such that there is enough clearance between the slide and the protrusions such that the protrusions are able to push against the sight without scraping the slide itself.

Once the sight is positioned adjacent to the protrusion of the pushing member, the supporting member is moved in the opposing Y-direction until the slide is braced between the seating member and the supporting member, as is indicated by block 408. To secure the slide, the pressure plate is then moved in the X-direction until the slide is braced between the pressure plate and the bracing member, as indicated by block 410. Finally, as indicated by block 412, the position of the sight is adjusted by moving the pushing member such that one of the protrusions of the pushing member pushes against a side of the sight until the sight is installed, removed, or adjusted.

While the preferred embodiments of the present invention have been illustrated in detail, it should be apparent that modifications and adaptations to those embodiments may occur to one skilled in the art without departing from the scope of the present invention.

What is claimed is:

1. A gun sight adjustment device, comprising:

a pushing member moveable in a first direction and an opposing second direction;

a pressure plate movable in the first direction and the opposing second direction;

a bracing member opposing the pressure plate, wherein the bracing member is stationary;

a seating member disposed between the pressure plate and bracing member, wherein the seating member opposes the pushing member, wherein the seating member is movable in a third direction and an opposing fourth direction;

a frame having at least four sides, wherein the first side opposes the third side, wherein the second side opposes the fourth side, wherein the second side and the fourth side are perpendicular to the first side and the third side, wherein the bracing member is fixed to the first side;

a first rotatable screw extending through the first side and the third side, wherein the pushing member is moveably disposed on the first rotatable screw;

a second rotatable screw extending through the third side, wherein the pressure plate is moveably disposed on the second screw; and a third rotatable screw extending through the fourth side, wherein the seating member is moveably disposed on the third screw.

2. The gun sight adjustment device of claim 1, further comprising a supporting member opposed to the seating member, wherein the supporting member is moveable in the third direction and an opposing forth direction.

3. The gun sight adjustment device of claim 2, wherein:

the supporting member comprises a first fixturing surface;

the seating member comprises a second fixturing surface;

the first fixturing surface and the second fixturing surface have a facing relationship;

the gun sight adjustment device further comprises a coating disposed on the first fixturing surface and the second fixturing surface.

4. The gun sight adjustment device of claim 2, further comprising:

a frame having at least four sides, wherein the first side opposes the third side, wherein the second side opposes the fourth side, wherein the second side and the fourth side are perpendicular to the first side and the third side; and a rotatable screw extending through the second side, wherein the supporting member is moveably disposed on the rotatable screw.

5. The gun sight adjustment device of claim 4, further comprising a guide rod extending through the second side, wherein the supporting member is further moveably disposed on the guide rod.

6. The gun sight adjustment device of claim 1, wherein the pressure plate and the seating member have interlocking shapes.

7. The gun sight adjustment device of claim 6, further comprising:

a frame having at least four sides, wherein the first side opposes the third side, wherein the second side opposes the fourth side, wherein the second side and the fourth side are perpendicular to the first side and the third side;

a rotatable screw extending through the fourth side, wherein the seating member is moveably disposed on the rotatable screw; and a first guide rod extending through the fourth side, wherein the supporting member is further moveably disposed on the first guide rod.

8. The gun sight adjustment device of claim 7, wherein the first guide rod is between the rotatable screw and the third side, the gun sight adjustment device further comprising a second guide rod extending through the fourth side and between the rotatable screw and the first side, wherein the seating member is further disposed on the second guide rod.

9. The gun sight adjustment device of claim 1, wherein:

the pressure plate comprises a first fixturing surface;

the bracing member comprises a second fixturing surface;

the first fixturing surface and the second fixturing surface have a facing relationship;

the gun sight adjustment device further comprises a coating disposed on the first fixturing surface and the second fixturing surface.

10. A method of adjusting a gun sight, comprising supplying a gun sight adjustment device comprising:

a pushing member moveable in a first direction and an opposing second direction;

a pressure plate movable in the first direction and the opposing second direction;

a bracing member opposing the pressure plate, wherein the bracing member is stationary; and a seating member disposed between the pressure plate and bracing member, wherein the seating member opposes the pushing member, wherein the seating member is movable in a third direction and an opposing fourth direction;

supplying a pistol comprising a slide and a removeable sight moveably disposed in a groove formed in a top of the slide;

extending the pistol into the gun sight adjustment device such that a portion of the slide is disposed between the pressure plate and the bracing member;

moving the seating member in the third direction to position the sight adjacent to the pushing member;

moving the pressure plate in the first direction to fixture the slide between the pressure plate and the bracing member; and moving the pushing member to adjust the position of the sight in the groove.

11. The method of claim 10, wherein the gun sight adjustment device further comprises a supporting member opposed to the seating member, wherein the supporting member is moveable in the third direction and an opposing forth direction, the method further comprising moving the supporting member in the opposing forth direction to fixture the slide between the supporting member and the seating member.

12. The method of claim 10, wherein said extending further comprises positioning the portion of the slide against the bracing member.

13. The method of claim 10, wherein the pushing member further comprise a first protrusion, wherein the method further comprises bringing the first protrusion in contact with the sight.

14. The method of claim 13, wherein said moving the seating member further comprises positioning the sight at a height where, when the pushing member is moved, the first protrusion will make contact with the sight and the first protrusion will not make contact with the slide.

15. The method of claim 13, wherein the pushing member further comprises a second protrusion, wherein the first protrusion and the second protrusion define an opening, wherein said moving the seating member further comprises positioning the sight within the opening.

16. The method of claim 10, wherein the groove has an edge, wherein said supplying a pistol further comprises placing the sight at the edge such that the sight is held within place by friction.

17. The method of claim 10, wherein the gun sight adjustment device further comprises:

a frame having at least four sides, wherein the first side opposes the third side, wherein the second side opposes the fourth side, wherein the second side and the fourth side are perpendicular to the first side and the third side, wherein the bracing member is fixed to the first side;

a rotatable screw having a first end and a second end, wherein the first end extends through the first side and the second end extends the third side, wherein the pushing member is moveably disposed on the rotatable screw; and a handle disposed on the first end of the rotatable screw, wherein when the handle is turned the pushing member is moved in either the first direction or the opposing second direction;

the method further comprising, turning the handle.

* * * * *